United States Patent [19]

Schmid et al.

[11] Patent Number: 4,700,446

[45] Date of Patent: Oct. 20, 1987

[54] FORGING PROCESS

[75] Inventors: Anton Schmid; Georg Tauschek, both of Munich; Andreas Sedlmeier, Ummendorf; Peter Pollok, Munich, all of Fed. Rep. of Germany

[73] Assignee: Bayerisches Leichtmetallwerk Graf Blucher von Wahlstatt GmbH, Munich, Fed. Rep. of Germany

[21] Appl. No.: 857,744

[22] PCT Filed: Jul. 8, 1985

[86] PCT No.: PCT/EP85/00335

§ 371 Date: Mar. 20, 1986

§ 102(e) Date: Mar. 20, 1986

[87] PCT Pub. No.: WO86/00838

PCT Pub. Date: Feb. 13, 1986

[51] Int. Cl.[4] ..... B21K 1/30

[52] U.S. Cl. ..... 29/159.2; 72/377

[58] Field of Search ..... 29/159.2, DIG. 49; 72/53, 75, 76, 67, 68, 377

[56] References Cited

U.S. PATENT DOCUMENTS

| | | | |
|---|---|---|---|
| 3,298,219 | 1/1967 | Schober | 29/159.2 |
| 3,688,549 | 9/1972 | Ohnishi et al. | 29/159.2 |

FOREIGN PATENT DOCUMENTS

| | | | |
|---|---|---|---|
| 2448473 | 6/1975 | Fed. Rep. of Germany . | |
| 120433 | 7/1983 | Japan | 29/159.2 |
| 1058699 | 12/1983 | U.S.S.R. | 72/75 |

*Primary Examiner*—Lowell A. Larson

[57] ABSTRACT

A process for the manufacture of a synchronizing component, provided with a short toothing having undercut teeth, for a shift transmission by precision forging, in which the teeth, the radially inner side of which lies against a common cylindrical surface and the base of which is placed on a common lower plane surface, being first manufactured with parallel tooth flanks and then subjected to final clenching, permits especially precise formation of the coupling surfaces, the following process steps being essential:

(a) by means of preliminary forging a semi-finished product is produced the short toothing of which has teeth (7) having excess dimensions exceeding the finished tooth head (10), (b) by means of one or more subsequent calibrating strokes the cold semi-finished product is acted upon in such a manner that (aa) firstly the tooth head (10) are subjected to preliminary clenching, the radially outer sides of the teeth being supported on the forging-die side, (bb) simultaneously with the preliminary clenching operation, or by means of a further calibrating stroke, by rounding out the tooth flanks (9) to the lower plane surface (5), cold compacting is produced in each case in the base region of the teeth (7), (cc) during the final clenching operation the tooth heads acquire a roof-shape and the tooth flanks acquire an obliquity corresponding to their undercuts.

4 Claims, 3 Drawing Figures

FORGING PROCESS

The invention relates to a process for manufacturing a synchronising component, provided with a short toothing having undercut teeth, for shift transmissions by precision forging. The teeth, the radially inner side of which lies against a common cylindrical surface and the base of which is placed on a common lower plane surface, is first manufactured with parallel tooth flanks and then subjected to final clenching.

Such a process for manufacturing force-transmitting coupling components having claws or pockets is known from DE Al No. 31 34 857. In that specification claws are produced during preliminary forging the head, surfaces of which are manufactured oversize, at least along their edges that are common with the coupling surfaces. By means of a subsequent calibrating stroke the desired obliquity of the coupling surfaces is achieved. During calibration, the claws can be supported between forging-die surfaces extending transversely to the coupling surfaces.

It is also known (German Auslegeschrift No. 2 040 413) when manufacturing wedge-toothed wheels having undercut teeth to manufacture, by rough pressing, teeth having parallel tooth flanks which are then finally clenched, with the formation of a roof-shape. The obliquity of the tooth flanks for achieving the undercut tooth shape in this case is produced using a special bevelling device, with which radially movable punches enter into the tooth spaces.

The use of the known forging process for the manufacture of synchronising components, provided with a short toothing, for shift transmissions is limited at least in the case of high precision requirements and in the case of very small synchronising components. Because the side flanks of the dogs forming the coupling surfaces are shaped freely by clenching the extra material of the head, the precision of the formation of the coupling surfaces cannot readily be increased.

In contrast, the problem underlying the present invention is to permit unrestricted use of the known process on synchronising components, of the type mentioned, to achieve increased precision in the formation of the coupling surfaces.

This problem is solved according to the invention by providing a process for manufacture of a finished synchronizing component for shift transmissions from a semi-finished synchronizing component, having a short toothing, formed by preliminary forging, said short toothing comprising undercut teeth, the radially inner sides of which lie against a common cylindrical surface which extends between upper and lower planar surfaces, the lower planar surface extending outwardly from a lower end of the cylindrical surface in perpendicular relation thereto, an upper end of the cylindrical surface terminating flush with the upper planar surface, said teeth of said semi-finished synchronizing component having a base portion on said lower planar surface and additionally having parallel tooth planks and a height exceeding that of the teeth of said finished synchronizing component, subjecting the tooth heads to a preliminary clenching during which material compression of the semi-finished component takes place, cold compacting the base region of the teeth on the lower planar surface to round out said teeth flanks at their bases, and subjecting the tooth heads to final clenching to impart a roof shape to the heads of said teeth and an obliqueness to the teeth flanks corresponding to their undercuts.

Essentially therefore the process of the invention entails (a) a "preliminary forging" step and (b) a "cold calibrating" step. Step (a) may entail cold or warm forging or equivalent press forming.

Step (b), entails at least one calibrating stroke and comprises a three-stage shaping process by calibrating and is in that respect fundamentally different from the mentioned prior art.

In a first stage (aa) of step (b), the tooth heads, which have been manufactured oversize in direction of the tooth length in the preliminary forging step (a), are first of all subjected to preliminary clenching; during that process the tooth flanks, which are straight, that is to say extend in radial planes with respect to the cylindrical surface that is common to all the teeth, remain substantially intact. A material compression takes place, which then leads in the second shaping stage (bb) to cold compacting especially in the base region of the teeth which is supported by the lower planar surface. This cold compacting in the base region is not only very important for the precise formation of the rounded portion of the base of the teeth; its special effect is that, during the subsequent final clenching of the tooth shape in a third shaping stage (cc), it precisely controls the obliquity of the tooth flanks forming the coupling surface. Depending of tooth length, undercut and shape accuracy of tooth flanks a support of the tooth flanks by the forging die may be appropriate. At the same time, during the third shaping stage (cc) the roof-shape of the tooth heads, which is characteristic of short toothings, is completed and the tooth flanks receive their final obliquity.

It is possible in principle to carry out the three shaping stages using a so-called "preceding" forging die within a single calibrating stroke. Advantageously, however, two calibrating strokes are used, the first effecting shaping stages (aa) and (bb) and the second finally shaping stage (cc).

Experience has shown that synchronising components manufactured by this process have a short toothing that satisfies all the demands made on shift transmissions in vehicle construction.

In a development of the invention it is important in the manufacture of the semi-finished product that the cylindrical surface should be limited in the region of the tooth heads by an upper plane surface beyond which at least part of the extra material of the tooth heads of the semi-finished product projects and that the teeth are shaped during the final clenching operation in such a manner that the tooth heads end in or below the upper plane surface.

The degree of shaping during the clenching of the tooth heads should be controlled in such a manner that, at the latest during the final clenching operation, the teeth formed on the semi-finished product are sheared off from the cylindrical surface in a region between the upper plane surface and the finished tooth-head shape. It is easy to conceive in this connection that the sheared-off material is deformed in the direction of the gap between the teeth to form the oblique tooth flanks; the cylindrical surface common to all the teeth forms an effective support surface that does not impede the shaping process and that need not be connected to the tooth in the region of the greatest tooth width.

The manufacture of a synchronising component is described below with reference to the drawing.

Figure 1:
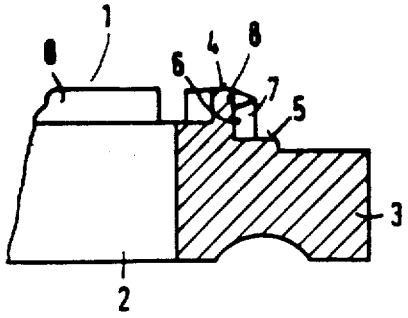
FIG. 1 shows an axial semi-section through a synchronising component.

The semi-section shown in FIG. 1 through a synchronising component 1 having a central bore 2 and chosen from a plurality of possible variants shows, in a hatched cross-section, an annular body 3 on which a cylindrical surface 6 is formed between an upper plane surface 4 and a lower plane surface 5. Attached to the cylindrical surface 6 are the teeth 7 of a short toothing, a total of four segments 8, each having five teeth attached to it, being distributed over the periphery of the synchronising component 1.

Figure 2:
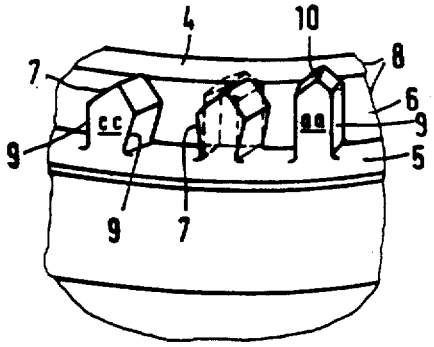
FIG. 2 shows a perspective section of the synchronising component in a side view with teeth in varying stages of shaping and FIG. 3 shows a diagrammatic representation of a tooth in three different stages of shaping.

FIG. 2 shows a section of such a segment 8 with a final shaped tooth 7 and two other teeth which represent intermediate stages of the manufacturing process. The right-hand tooth labelled (aa) is the tooth shape of the semi-finished product manufactured by the hot forging process. This tooth has tooth flanks 9 extending along radial planes relative to the segment 8, and a roof-shaped tooth head 10, the roof-shape coming to rest slightly above the upper plane surface 4 of the segment 8. On the left a final finished tooth 7 designated (cc) is represented, although the inclination of the tooth flanks 9 forming its coupling surfaces is drawn in a highly exaggerated manner. This tooth is clearly shorter in length than the tooth of shaping stage (aa) shown on the right; this is a result of two clenching operations, one from the forged shape (aa) into the intermediate shape (bb) shown in FIG. 3 and the second into the final finished shape (cc). The two last-mentioned shaping shapes (bb) and (cc) are preferably effected by means of two successive calibrating strokes. According to FIG. 2, the tip of the tooth head of the finished tooth 7 coincides approximately with the plane surface 4. This geometric relationship is, however, not essential. The tooth head in other synchronising components can either project slightly beyond the upper plane surface 4 or lie slightly beneath it.

The central representation of a tooth according to FIG. 2 shows, drawn one on top of the other, a finished tooth 7 (continuous line) according to left hand shape (cc) and a forged tooth (dotted line) according to the right-hand shape (aa) of the semi-finished product. The central tooth representation is intended to show the degree of shaping from the preliminary forging operation to the finished calibrating operation. This can be seen especially clearly from the representation according to FIG. 3. According to FIG. 3, the cylindrical surface 6, projected into the plane, is shown between two broken lines. Also the shaping stages (aa) and (bb) involving preliminary clenching and (cc) for the final clenching is exaggerated to illustrate the ratios. The two last-mentioned shaping stages (bb) and (cc) take place in a calibrating process, by means of one or more calibrating strokes. It is essential that within preliminary clenching—including shaping stage (bb)—cold compacting is achieved within zones 11 around the rounded portion 12 of the base of the teeth. This cold compacting is a substantial cause of the tooth flanks 9 of the finally calibrated tooth 7 which form the coupling surfaces forming an exact plane surface which extends upwards at the desired angle in order to broaden the tooth head.

Figure 3:
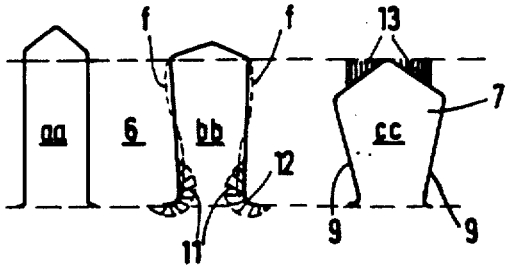

By means of a per se known preceding forging die (not shown), it is possible while calibrating in shaping stage (bb) first to produce the rounded portion 12 of the base by preliminary clenching of the tooth from shaping stage (aa) to shaping stage (bb). This produces a scarcely recognisable obliquity of the tooth flanks 9 in shaping stage (bb). Only during the final clenching within shaping stage (cc) do these acquire the desired obliquity. A comparison of shaping stage (aa) shown on the left (see FIG. 3) with the final step (cc) shown on the right shows the shaded shear region 13 on the cylindrical surface 6, from which region material transport takes place which as a result permits the head of the finished tooth to be broadened. The tooth shapes of FIGS. 2 and 3 are shown substantially diagrammatically. In reality, the edges, especially those of the intermediate shapes (aa) and (bb), are slightly rounded and the obliquity of the tooth flanks in the final shape (cc) is distinctly smaller. After the first calibrating step (shaping stage (bb), the tooth flanks can be slightly convex near the head and below that can extend in slightly concave manner as shown in FIG. 3 by a broken line.

What is claimed is:

1. Process for manufacture of a finished synchronizing component for shift transmissions from a semi-finished synchronizing component, having a short toothing, formed by preliminary forging, said short toothing comprising undercut teeth, the radially inner sides of which lie against a common cylindrical surface which extends between upper and lower planar surfaces, the lower planar surface extending outwardly from a lower end of the cylindrical surface in perpendicular relation thereto, an upper end of the cylindrical surface terminating flush with the upper planar surface, said teeth of said semi-finished synchronizing component having a base portion on said lower planar surface and additionally having parallel tooth flanks and a height exceeding that of the teeth of said finished synchronizing component, subjecting the tooth heads to a preliminary clenching during which material compression of a semi-finished component takes place, cold compacting the base region of the teeth on the lower planar surface to round out said teeth flanks at their bases, and subjecting the tooth heads to final clenching to impart a roof shape to the heads of said teeth and an obliqueness to the teeth flanks corresponding to their undercuts.

2. Process according to claim 1, wherein said preliminary and final clenching steps are effected by two calibrating strokes.

3. Process according to claim 1, wherein said tooth heads after said final clenching extend at most, in height, to said upper planar surface.

4. Process according to claim 1, wherein during the final clenching, the teeth on the semi-finished product are sheared from the cylindrical surface.

* * * * *

UNITED STATES PATENT AND TRADEMARK OFFICE

CERTIFICATE OF CORRECTION

PATENT NO. : 4,700,446

DATED : October 20, 1987

INVENTOR(S) : Anton Schmid et al

It is certified that error appears in the above-identified patent and that said Letters Patent is hereby corrected as shown below:

On the front page of the patent, add:

--[30] Foreign Application Priority Data
July 24, 1984 [DE] West Germany.....P 3427156.2--.

Signed and Sealed this

Twenty-first Day of June, 1988

*Attest:*

DONALD J. QUIGG

*Attesting Officer*

*Commissioner of Patents and Trademarks*